US011884890B1

(12) United States Patent
Wang et al.

(10) Patent No.: US 11,884,890 B1
(45) Date of Patent: Jan. 30, 2024

(54) GASOLINE ADDITIVE COMPOSITION FOR IMPROVED ENGINE PERFORMANCE

(71) Applicant: Afton Chemical Corporation, Richmond, VA (US)

(72) Inventors: Janice Jianzhao Wang, Glen Allen, VA (US); Julienne Galante-Fox, Midlothian, VA (US); Shannon Bendel, Chesterfield, VA (US); Saeid Shirazi, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/165,630

(22) Filed: Feb. 7, 2023

(51) Int. Cl.

| | |
|---|---|
| ***C10L 1/222*** | (2006.01) |
| ***C10L 1/182*** | (2006.01) |
| ***C10L 10/18*** | (2006.01) |
| ***C10L 1/2383*** | (2006.01) |

(52) U.S. Cl.
CPC ..... *C10L 1/2225* (2013.01); *C10L 1/1822* (2013.01); *C10L 1/2383* (2013.01); *C10L 10/18* (2013.01); *C10L 2200/0423* (2013.01)

(58) Field of Classification Search
CPC .... C10L 1/2225; C10L 1/1822; C10L 1/2383; C10L 10/18; C10L 2200/0423
See application file for complete search history.

(56) References Cited

U.S. PATENT DOCUMENTS

| | | | |
|---|---|---|---|
| 2,425,755 | A | 8/1947 | Roberts et al. |
| 2,425,845 | A | 8/1947 | Toussaint et al. |
| 2,448,664 | A | 9/1948 | Fife et al. |
| 2,457,139 | A | 12/1948 | Fife et al. |
| 2,475,755 | A | 7/1949 | Pearson |
| 3,172,892 | A | 3/1965 | Le Suer et al. |
| 3,202,678 | A | 8/1965 | Stuart et al. |
| 3,216,936 | A | 11/1965 | Le Suer |
| 3,219,666 | A | 11/1965 | Norman et al. |
| 3,254,025 | A | 5/1966 | Le Suer |
| 3,272,746 | A | 9/1966 | Le Suer et al. |
| 3,361,673 | A | 1/1968 | Stuart et al. |
| 3,676,089 | A | 7/1972 | Morris et al. |
| 4,038,043 | A | 7/1977 | Garth |
| 4,152,499 | A | 5/1979 | Boerzel et al. |
| 4,171,959 | A | 10/1979 | Vartanian |
| 4,231,759 | A | 11/1980 | Udelhofen et al. |
| 4,234,435 | A | 11/1980 | Meinhardt et al. |
| 4,248,719 | A | 2/1981 | Chafetz et al. |

(Continued)

FOREIGN PATENT DOCUMENTS

| | | | |
|---|---|---|---|
| CA | 2089833 | A1 | 8/1993 |
| EP | 1293553 | A2 | 3/2003 |

(Continued)

OTHER PUBLICATIONS

Shanahan, Charles S. et al. "A General Method for Fouling Injectors in Gasoline Direct Injection Vehicles and the Effects for Deposits on Vehicle Performance," SAE Int. J. Fuels Lubr. 10(3):2017, doi:10.4271/2017-01-2298.

*Primary Examiner* — Vishal V Vasisth
(74) *Attorney, Agent, or Firm* — Honigman LLP

(57) ABSTRACT

The present disclosure provides fuel additives including quaternary ammonium salt additive(s) and Mannich detergent additive(s) effective to improve engine performance in both port fuel injected and gasoline direct injection engines.

18 Claims, 1 Drawing Sheet

(56) References Cited

U.S. PATENT DOCUMENTS

| | | | |
|---|---|---|---|
| 4,605,808 | A | 8/1986 | Samson |
| 4,613,341 | A | 9/1986 | Zaweski et al. |
| 4,729,769 | A | 3/1988 | Schlicht et al. |
| 4,844,714 | A | 7/1989 | Vogel et al. |
| 4,877,416 | A | 10/1989 | Campbell |
| 5,254,138 | A | 10/1993 | Kurek |
| 5,393,309 | A | 2/1995 | Cherpeck |
| 5,514,190 | A | 5/1996 | Cunningham et al. |
| 5,518,511 | A | 5/1996 | Russell et al. |
| 5,575,823 | A | 11/1996 | Wallace et al. |
| 5,620,486 | A | 4/1997 | Cherpeck |
| 5,634,951 | A | 6/1997 | Colucci et al. |
| 5,697,988 | A | 12/1997 | Malfer et al. |
| 5,725,612 | A | 3/1998 | Malfer et al. |
| 5,814,111 | A | 9/1998 | Graham et al. |
| 5,873,917 | A | 2/1999 | Daly |
| 5,876,468 | A | 3/1999 | Moreton |
| 6,048,373 | A | 4/2000 | Malfer et al. |
| 6,166,238 | A | 12/2000 | Filipkowski et al. |
| 6,458,172 | B1 | 10/2002 | MacDuff et al. |
| 6,475,250 | B2 | 11/2002 | Krull et al. |
| 6,548,458 | B2 | 4/2003 | Loper |
| 6,695,890 | B1 | 2/2004 | Hazel et al. |
| 6,730,773 | B2 | 5/2004 | Heinen |
| 6,800,103 | B2 | 10/2004 | Malfer et al. |
| 6,867,171 | B2 | 3/2005 | Harrison et al. |
| 7,402,185 | B2 | 7/2008 | Aradi et al. |
| 7,435,272 | B2 | 10/2008 | Aradi et al. |
| 7,704,289 | B2 | 4/2010 | Arters et al. |
| 7,766,982 | B2 | 8/2010 | Colucci et al. |
| 8,097,570 | B2 | 1/2012 | Boitout et al. |
| 8,153,570 | B2 | 4/2012 | Barton et al. |
| 8,231,695 | B2 | 7/2012 | Cunningham et al. |
| 8,425,627 | B2 | 4/2013 | Dietz et al. |
| 8,449,630 | B2 | 5/2013 | Lange et al. |
| 8,486,876 | B2 | 7/2013 | Brewer et al. |
| 8,496,716 | B2 | 7/2013 | Lange et al. |
| 8,529,643 | B2 | 9/2013 | Galante-Fox et al. |
| 8,557,003 | B2 | 10/2013 | Malfer et al. |
| 8,765,650 | B2 | 7/2014 | Delbridge et al. |
| 8,778,034 | B2 | 7/2014 | Cunningham |
| 8,894,726 | B2 | 11/2014 | Fang et al. |
| 9,951,285 | B2 | 4/2018 | Roeger-Goepfert et al. |
| 10,273,425 | B2 * | 4/2019 | Tabibi ..... C10L 1/023 |
| 10,308,888 | B1 * | 6/2019 | Schwab ..... C10L 1/224 |
| 2004/0060226 | A1 | 4/2004 | Bongart et al. |
| 2005/0066572 | A1 | 3/2005 | Colucci |
| 2005/0215411 | A1 | 9/2005 | Masahara et al. |
| 2006/0070293 | A1 | 4/2006 | Lange et al. |
| 2006/0168876 | A1 | 8/2006 | Colucci et al. |
| 2006/0196110 | A1 | 9/2006 | Schwahn et al. |
| 2006/0196111 | A1 | 9/2006 | Colucci |
| 2007/0245621 | A1 | 10/2007 | Malfer |
| 2008/0086936 | A1 | 4/2008 | Cunningham |
| 2009/0049740 | A1 | 2/2009 | Hurst |
| 2009/0235576 | A1 | 9/2009 | Volkel et al. |
| 2010/0005706 | A1 | 1/2010 | Burgazli et al. |
| 2010/0132253 | A1 | 6/2010 | Kaufman et al. |
| 2011/0162263 | A1 | 7/2011 | Vilardo et al. |
| 2012/0138004 | A1 | 6/2012 | Stevenson et al. |
| 2013/0031828 | A1 | 2/2013 | Reid et al. |
| 2013/0104826 | A1 | 5/2013 | Burgess et al. |
| 2013/0227878 | A1 | 9/2013 | Wolf et al. |
| 2013/0237466 | A1 | 9/2013 | Lange et al. |
| 2013/0247450 | A1 | 9/2013 | Wolf |
| 2013/0255139 | A1 | 10/2013 | Dolmazon et al. |
| 2013/0312318 | A1 | 11/2013 | Peretolchin et al. |
| 2013/0324665 | A1 | 12/2013 | Shaikh et al. |
| 2014/0157656 | A1 | 6/2014 | Reid |
| 2014/0174390 | A1 | 6/2014 | Reid et al. |
| 2015/0252278 | A1 | 9/2015 | Bush et al. |
| 2016/0130514 | A1 | 5/2016 | Hansch et al. |
| 2016/0152910 | A1 | 6/2016 | Reid et al. |
| 2016/0152912 | A1 | 6/2016 | Mulqueen |
| 2016/0272912 | A1 | 9/2016 | Voelkel et al. |
| 2016/0289584 | A1 | 10/2016 | Russo et al. |
| 2017/0096610 | A1 | 4/2017 | Bush et al. |
| 2017/0096611 | A1 | 4/2017 | Stevenson et al. |
| 2017/0101594 | A1 | 4/2017 | Stevenson et al. |
| 2017/0107438 | A1 | 4/2017 | Greenfield et al. |
| 2017/0114296 | A1 | 4/2017 | Arters et al. |
| 2017/0114297 | A1 | 4/2017 | Sampler et al. |
| 2017/0121628 | A1 | 5/2017 | Moreton et al. |
| 2017/0166826 | A1 | 6/2017 | Culley et al. |
| 2017/0218291 | A1 | 8/2017 | Reid et al. |
| 2018/0066202 | A1 | 3/2018 | Gahagan et al. |
| 2018/0223203 | A1 | 8/2018 | Cook |

FOREIGN PATENT DOCUMENTS

| | | | |
|---|---|---|---|
| EP | 1411105 | A2 | 4/2004 |
| EP | 1918355 | A1 | 5/2008 |
| GB | 2493377 | A | 2/2013 |
| WO | 2004050806 | A2 | 6/2004 |
| WO | 2005023965 | A1 | 3/2005 |
| WO | 2017097686 | A1 | 6/2017 |

* cited by examiner

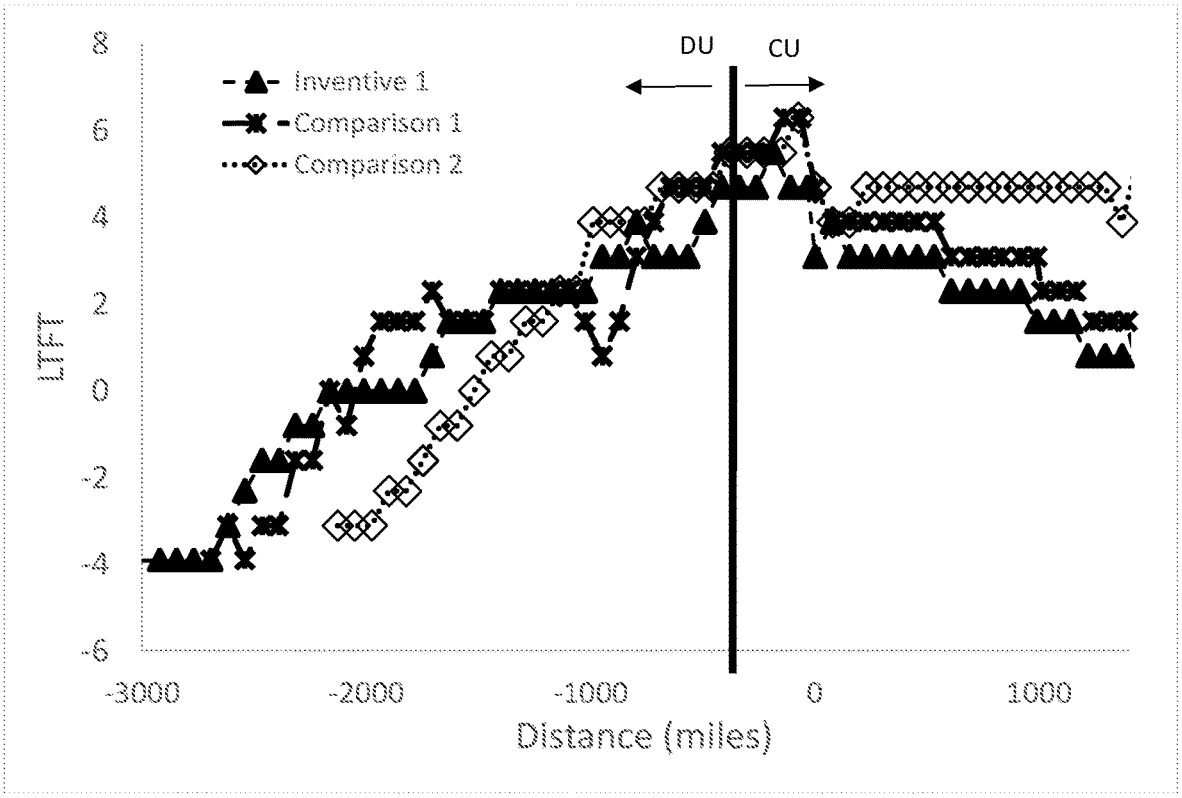
DU
CU
Inventive 1
Comparison 1
Comparison 2
LTFT
8
6
4
2
0
-2
-4
-6
-3000
-2000
-1000
0
1000
Distance (miles)

GASOLINE ADDITIVE COMPOSITION FOR IMPROVED ENGINE PERFORMANCE

TECHNICAL FIELD

This disclosure is directed to fuel additives for internal combustion engines providing enhanced engine and/or injector performance, to fuel compositions including such additives, and to methods of using such fuel additives in a fuel composition.

BACKGROUND

Fuel compositions for vehicles are continually being improved to enhance various properties of the fuels in order to accommodate their use in newer, more advanced engines including both gasoline port fuel injected engines as well as gasoline direct injected engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic or one type of engine, but at the same time be detrimental to another characteristic of the fuel. In some instances, fuel additives effective in gasoline port fuel injection engines do not necessarily provide comparable performance in gasoline direct injection engines and vice versa. In yet other circumstances, fuel additives often require an unreasonably high treat rate to achieve desired effects, which tends to place undesirable limits on the available amounts of other additives in the fuel composition. Yet other fuel additives tend to be expensive and/or difficult to manufacture or incorporate in fuels. Such shortcomings are particularly true in the context of quaternary ammonium salt fuel additives that are often difficult or costly to manufacture and/or require relatively high treat rates for performance.

SUMMARY

In one aspect, a fuel additive package, a fuel, or a method of providing improved engine performance is provided herein.

In one embodiment or approach, a fuel additive package for an internal combustion engine is described herein to provide the improved engine performance and includes a Mannich detergent including the reaction product of a hydrocarbyl-substituted phenol, one or more aldehydes, and one or more amines; and a quaternary ammonium salt additive having the structure of Formula II $$[(R_{10})(R_{11})N—(CH_2)_n—X_m—(CH_2)_n—X_m—(CH_2)_n—N^{\oplus}(R_7)(R_8)(R_9)]M^{\ominus} \quad \text{(Formula II)}$$

wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and $R_{11}$ are independently selected from hydrogen, an alkyl group, an acyl group, or a hydrocarbyl substituted acyl group (optionally, $R_{10}$ and $R_{11}$ together with the N atom to which they are attached, combine to form a ring moiety (such as a succinimide)), the hydrocarbyl substituent of one or both of $R_{10}$ and $R_{11}$ have a number average molecular weight of about 700 or greater (as further described herein); $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and $M^{\ominus}$ is a carboxylate. The above-mentioned internal combustion engine can be a spark-ignition engine or a diesel engine.

In another embodiment or approach, the fuel additive package of the previous paragraph may include optional features or embodiments in any combination. These optional features or embodiments include one or more of the following: further comprising an alkoxylated alcohol; and/or wherein a weight ratio of the alkoxylated alcohol to the Mannich detergent is about 1.0 or less; and/or wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof, and/or wherein a weight ratio of the Mannich detergent to the quaternary ammonium salt additive is about 4:1 to about 100:1; and/or wherein the Mannich detergent has the structure of Formula I:

(Formula I)

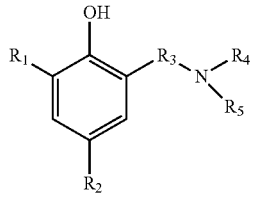

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group; and/or wherein $R_{10}$ and $R_{11}$ of the quaternary ammonium salt of Formula II, together with the nitrogen atom to which they are attached, combine to form a ring moiety; and/or wherein the carboxylate of the quaternary ammonium salt of Formula II is oxalate, salicylate, or combinations thereof; and/or wherein X of Formula II is —O— or —NH— (preferably —O—); and/or wherein the quaternary ammonium salt is derived from 3-(2-(dimethylamino)ethoxy) propylamine, N,N-dimethyldipropylenetriamine, or mixtures thereof, and/or wherein $R_{10}$ and $R_{11}$ of the quaternary ammonium salt of Formula II, together with the nitrogen atom to which they are attached, combine to form a hydrocarbyl substituted succinimide; and/or wherein the hydrocarbyl substituent has a number average molecular weight of about 700 to about 2,500; and/or wherein X moiety of the quaternary ammonium salt of Formula II is an oxygen atom and wherein $R_{10}$ and $R_{11}$ of the quaternary ammonium salt, together with the nitrogen atom to which they are attached, combine to form a hydrocarbyl substituted succinimide with the hydrocarbyl substituent having a number average molecular weight of about 700 to about 1,500 as measured by GPC using polystyrene as a calibration reference; and/or wherein the alkoxylated alcohol is a polyether having the structure of Formula Va:

(Formula Va)

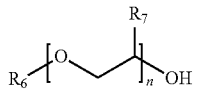

wherein $R_6$ is an aryl group or a linear, branched, or cyclic aliphatic group having 5 to 50 carbons, $R_7$ of Formula Va is a C1 to C4 alkyl group, and n is an integer from 5 to 100; and/or wherein the fuel additive package includes about 20 to about 60 weight percent of the Mannich detergent, about 1 to about 20 weight percent of the quaternary ammonium salt additive, and about 5 to about 30 weight percent of the alkoxylated alcohol; and/or further comprising a succinimide detergent prepared by reacting a hydrocarbyl-substituted succinic acylating agent with an amine, polyamine, or alkyl amine having one or more primary, secondary, or tertiary amino groups; and/or wherein the fuel additive package includes about 0.1 to about 10 weight percent of the succinimide detergent; and/or wherein the succinimide detergent is a hydrocarbyl substituted mono-succinimide detergent, a hydrocarbyl substituted bis-succinimide detergent, or a combination thereof, and/or further comprising one or more of a demulsifier, a corrosion inhibitor, an antiwear additive, an antioxidant, a metal deactivator, an antistatic additive, a dehazer, an antiknock additive, a lubricity additive, and/or a combustion improver.

In another aspect, a fuel including any embodiment of the above described fuel additive package is provided herein for improved engine performance. In one embodiment or approach, a gasoline fuel composition is provided that includes about 15 to about 300 ppmw of a Mannich detergent including the reaction product of a hydrocarbyl-substituted phenol, one or more aldehydes, and one or more amines; about 0.1 to about 50 ppmw of a quaternary ammonium salt additive (or about 0.1 to about 30 ppmw) has the structure of Formula II $$[(R_{10})(R_{11})N—(CH_2)_n—X_m—(CH_2)_n—X_m—(CH_2)_n—N^{\oplus}(R_7)(R_8)(R_9)]M^{\ominus} \quad \text{(Formula II)}$$

wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and $R_{11}$ are independently selected from hydrogen, an alkyl group, an acyl group, or a hydrocarbyl substituted acyl group (optionally, $R_{10}$ and $R_1$ together with the N atom to which they are attached, combine to form a ring moiety (such as a succinimide)), the hydrocarbyl substituent of one or both of $R_{10}$ and Rn having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and $M^{\ominus}$ is a carboxylate; and about 5 to about 150 ppmw of an alkoxylated alcohol. In another embodiment or approach, a diesel fuel composition is provided that includes about 15 to about 500 ppmw of a Mannich detergent including the reaction product of a hydrocarbyl-substituted phenol, one or more aldehydes, and one or more amines; about 0.1 to about 200 ppmw of a quaternary ammonium salt additive as described in any embodiment above.

In other embodiments, the fuel of the previous Paragraph may include any embodiment of the fuel additive package described in this Summary.

In yet other embodiments, a method of improving the injector performance of a gasoline direct injection (GDI) engine is described herein. In yet other embodiments, a method of improving the injector performance of a gasoline port fuel injection (PFI) engine is described herein. In further embodiments, a method of improving the injector performance of both GDI and PFI engines is described herein. Further, the use of a fuel additive package or a fuel for improving the injector performance of a GDI engine and/or a PFI engine is also described herein. In approaches or embodiments, the method or the use includes operating the gasoline direct injection engine on a fuel composition containing a major amount of a gasoline fuel and a minor amount of any embodiment of the fuel additive package as described in this Summary; and wherein the fuel additive package in the gasoline fuel improves the injector performance of the gasoline direct injection engine. In other approaches, the improved injector performance is one of improved fuel flow, improved fuel economy, improved engine efficiency, or combinations thereof; and/or wherein the improved injector performance is measured by one of injector pulse width, injection duration, injector flow, or combinations thereof.

In yet other embodiments, a method of improving the diesel engine performance is described herein. In further embodiments, a method of improving the injector performance of a diesel engine. Further, the use of a fuel additive package or a fuel as described in any embodiment herein for improving the injector performance of a diesel engine is also described herein. In approaches or embodiments, the method or the use includes operating the diesel engine on a fuel composition containing a major amount of a diesel fuel and a minor amount of any embodiment of the fuel additive package as described in this Summary; and wherein the fuel additive package in the diesel fuel improves the injector performance of the diesel engine, i.e., a direct injection or indirect injection engine. In other approaches, the engine performance is one of improved fuel flow, improved fuel economy, improved engine efficiency, or combinations thereof; and/or wherein the improved injector performance is measured by one of injector pulse width, injection duration, injector flow, or combinations thereof.

The method or the use of the previous paragraphs may include optional steps, features, or limitations in any combination thereof. Approaches or embodiments of the method or use may include one or more of the following: wherein the improved injector performance is one of improved fuel flow, improved fuel economy, improved engine efficiency, or combinations thereof, and/or wherein the improved injector performance is measured by one of long term fuel trim, injector pulse width, injection duration, injector flow, or combinations thereof.

BRIEF DESCRIPTION OF THE DRAWING FIGURE

FIG. 1 is a graph showing Long Term Fuel Trim (LTFT) of Comparative and Inventive fuel additives.

DETAILED DESCRIPTION

The present disclosure relates to fuel additives including combinations of Mannich detergents and quaternary ammonium salts and, in particular, Mannich detergents and high molecular weight, polyamine and/or ether amine derived hydrocarbyl-substituted quaternary ammonium salts discovered effective to provide improved engine and/or injector performance in both port fuel injection (PFI) engines as well as gasoline direct injection (GDI) engines. The fuel additives, in some approaches, may also include alkoxylated alcohols and, when included, certain ratios of the alkoxylated alcohol to the Mannich detergent. Also provided herein are fuel compositions including the novel fuel additive combinations and methods of using or combusting a fuel including the fuel additive combinations herein to achieve the improved engine and/or injector performance.

In aspects or embodiments of this disclosure, improved engine and/or injector performance of the fuel additive combinations herein may include one or more of controlling or reducing fuel injector deposits, controlling or reducing intake valve deposits, controlling or reducing combustion chamber deposits and/or controlling or reducing intake valve sticking. Improved injector performance may also be one or more of improved fuel flow, improved fuel economy, and/or improved engine efficiency as determined via one or more of long term fuel trim, injector pulse width, injection duration, and/or injector flow.

The present disclosure also relates to fuel additives including combinations of Mannich detergents and quaternary ammonium salts and, in particular, Mannich detergents and high molecular weight, polyamine and/or ether amine derived hydrocarbyl-substituted quaternary ammonium salts discovered effective to provide improved engine and/or injector performance in diesel engines. The diesel engines contain a conventional distributor injection pump, a pump-nozzle system (unit-injector system or unit-pump system) or a common-rail system.

In aspects or embodiments of this disclosure, improved engine and/or injector performance of the fuel additive combinations herein may include one or more of controlling or reducing fuel injector deposits, controlling or reducing intake valve deposits, controlling or reducing combustion chamber deposits and/or controlling or reducing intake valve sticking. Improved injector performance may also be one or more of improved fuel flow, improved fuel economy, and/or improved engine efficiency as determined via one or more of long term fuel trim, injector pulse width, injection duration, and/or injector flow.

Mannich Detergent

In one aspect, the fuel additives and fuels herein include a Mannich detergent. Suitable Mannich detergents include the reaction product(s) of an alkyl-substituted hydroxyaromatic or phenol compound, aldehyde, and amine as discussed more below.

In one approach, the alkyl substituents of the hydroxyaromatic compound may include long chain hydrocarbyl groups on a benzene ring of the hydroxyaromatic compound and may be derived from an olefin or polyolefin having a number average molecular weight (Mn) from about 500 to about 3000, preferably from about 700 to about 2100, as determined by gel permeation chromatography (GPC) using polystyrene as reference. The polyolefin, in some approaches, may also have a polydispersity (weight average molecular weight/number average molecular weight) of about 1 to about 10 (in other instances, about 1 to 4 or about 1 to about 2) as determined by GPC using polystyrene as reference.

The alkylation of the hydroxyaromatic or phenol compound is typically performed in the presence of an alkylating catalyst at a temperature in the range of about 0 to about 200° C., preferably 0 to 100° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

Polyolefins suitable for forming the alkyl-substituted hydroxyaromatic compounds of the Mannich detergents include polypropylene, polybutenes, polyisobutylene, copolymers of butylene and/or butylene and propylene, copolymers of butylene and/or isobutylene and/or propylene, and one or more mono-olefinic comonomers copolymerizable therewith (e.g., ethylene, 1-pentene, 1-hexene, 1-octene, 1-decene, etc.) where a copolymer molecule contains at least 50% by weight, of butylene and/or isobutylene and/or propylene units. Any comonomers polymerized with propylene or butenes may be aliphatic and can also contain non-aliphatic groups, e.g., styrene, o-methylstyrene, p-methylstyrene, divinyl benzene and the like if needed. Thus, the resulting polymers and copolymers used in forming the alkyl-substituted hydroxyaromatic compounds are substantially aliphatic hydrocarbon polymers.

Polybutylene is preferred for forming the hydrocarbyl-substituted hydroxyaromatic or phenol compounds herein. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polyisobutenes having relatively high proportions of polymer molecules having a terminal vinylidene group are also suitable for use in forming the long chain alkylated phenol reactant. Suitable high-reactivity polyisobutenes include those polyisobutenes that comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, which are both incorporated herein by reference.

The Mannich detergent, in some approaches or embodiments, may be made from an alkylphenol or alkylcresol. However, other phenolic compounds may be used including alkyl-substituted derivatives of resorcinol, hydroquinone, catechol, hydroxydiphenyl, benzylphenol, phenethylphenol, naphthol, tolylnaphthol, among others. Preferred for the preparation of the Mannich detergents are the polyalkylphenol and polyalkylcresol reactants, e.g., polypropyl phenol, polybutylphenol, polypropylcresol and polybutylcresol, wherein the alkyl group has a number average molecular weight of about 500 to about 3000 or about 500 to about 2100 as measured by GPC using polystyrene as reference, while the most preferred alkyl group is a polybutyl group derived from polyisobutylene having a number average molecular weight in the range of about 700 to about 1300 as measured by GPC using polystyrene as reference.

The preferred configuration of the alkyl-substituted hydroxyaromatic compound is that of a para-substituted mono-alkylphenol or a para-substituted mono-alkyl orthocresol. However, any hydroxyaromatic compound readily reactive in the Mannich condensation reaction may be employed. Thus, Mannich products made from hydroxyaromatic compounds having only one ring alkyl substituent, or two or more ring alkyl substituents are suitable for forming this detergent additive. The alkyl substituents may contain some residual unsaturation, but in general, are substantially saturated alkyl groups.

In approaches or embodiments, representative amine reactants suitable to form the Mannich detergent herein include, but are not limited to, alkylene polyamines having at least one suitably reactive primary or secondary amino group in the molecule. Other substituents such as hydroxyl, cyano, amido, etc., can be present in the polyamine. In a one embodiment, the alkylene polyamine is a polyethylene polyamine. Suitable alkylene polyamine reactants include ethylenediamine, diethylenetriamine, triethylenetetramine, tetraethylene pentamine and mixtures of such amines having nitrogen contents corresponding to alkylene polyamines of the formula $H_2N$-(A-NH—)$_n$H, where A in this formula is divalent ethylene or propylene and n is an integer of from 1 to 10, preferably 1 to 4. The alkylene polyamines may be obtained by the reaction of ammonia and dihalo alkanes, such as dichloro alkanes.

The amine may also be an aliphatic diamine having one primary or secondary amino group and at least one tertiary amino group in the molecule. Examples of suitable polyamines include N,N,N",N"-tetraalkyldialkylenetriamines (two terminal tertiary amino groups and one central secondary amino group), N,N,N',N"-tetraalkyltrialkylene tetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), N,N'-dialkylamine, N,N-dihydroxyalkyl-alpha-, omega-alkylenediamines (one terminal tertiary amino group and one terminal primary amino group), N,N,N'-trihydroxyalkyl-alpha, omega-alkylenediamines (one terminal tertiary amino group and one terminal secondary amino group), tris(dialkylaminoalkyl) aminoalkylmethanes (three terminal tertiary amino groups and one terminal primary amino group), and similar compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omega-alkylene diamine, such as those having from 3 to about 6 carbon atoms in the alkylene group and from 1 to about 12 carbon atoms in each of the alkyl groups, which most preferably are the same but which can be different. Exemplary amines may include N,N-dimethyl-1,3-propanediamine and/or N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propane diamine-, N-(tert-butyl)-1-methyl-1,2-ethanediamine, N-(tert-butyl)-1-methyl-1,3-propane diamine, and 3,5-di (tert-butyl)aminoethylpiperazine.

In approaches or embodiments, representative aldehydes for use in the preparation of the Mannich detergents herein include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkylphenol, the specified amine(s) and the aldehyde may be conducted at a temperature typically in the range of about 40° C. to about 200° C. The reaction can be conducted in bulk (no diluent or solvent) or in a solvent or diluent. Water is evolved and can be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively. Suitable Mannich base detergents include those detergents taught in U.S. Pat. Nos. 4,231,759; 5,514,190; 5,634,951; 5,697,988; 5,725,612; and 5,876,468, the disclosures of which are incorporated herein by reference.

In other approaches or embodiments, suitable Mannich detergents for the fuel additives herein may have a structure of Formula I below:

(Formula I)

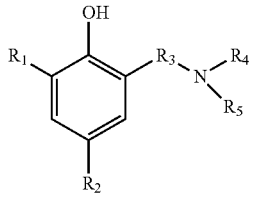

wherein $R_1$ is hydrogen or a C1 to C4 alkyl group, $R_2$ is a hydrocarbyl group having a number average molecular weight of about 500 to about 3,000 (or about 500 to about 2,100 or about 500 to about 1,800), $R_3$ is a C1 to C4 alkylene or alkenyl linking group, and $R_4$ and $R_5$ are, independently, hydrogen, a C1 to C12 alkyl group, or a C1 to C4 alkyl amino C1-C12 alkyl group.

A fuel additive or additive package may include about 10 to about 70 weight percent of the above-described Mannich detergent, about 20 to about 60 weight percent of the Mannich detergent, or about 30 to about 50 weight percent of the Mannich detergent (based on the total weight of the active Mannich detergent in the fuel additive). When blended into a gasoline fuel, the fuel composition may include about 15 ppmw to about 300 ppmw of the above-described Mannich detergent, about 25 ppmw to about 155 ppmw, or about 55 ppmw to about 125 ppmw of the Mannich detergent in the fuel composition (active Mannich detergent treat rates).

Quaternary Ammonium Salt Additive: In another approach, the mixtures herein also include a quaternary ammonium salt additive, and in particular, a polyamine or ether-amine derived hydrocarbyl-substituted succinimide quaternary ammonium salt additive having a high molecular weight hydrocarbyl substituent. In approaches, the quaternary ammonium salt of the mixtures herein includes a quaternary ammonium salt formed through a reaction between an alkyl carboxylate and an amide or imide compound obtained by reacting a hydrocarbyl substituted acylating agent, such as a high molecular weight hydrocarbyl substituted acylating agent, and a polyamine or, more preferably, an ether amine.

In one approach, the quaternary ammonium salt is a cationic salt having the structure of Formula II $$[(R_{10})(R_{11})N—(CH_2)_n—X_m—(CH_2)_n—X_m—(CH_2)_n—N^{\oplus}(R_7)(R_8)(R_9)]M^{\ominus}$$ (Formula II)

wherein each X is a bivalent moiety selected from the group consisting of —O—, —N(Ru)—, —C(O)—, —C(O)O—, or —C(O)$NR_{12}$; each $R_7$, $R_8$, and $R_9$ are independently alkyl groups containing 1 to 8 carbon atoms; $R_{10}$ and $R_{11}$ are independently selected from an alkyl group, an acyl group, or a hydrocarbyl substituted acyl group and, optionally, $R_{10}$ and $R_{11}$ together with the N atom to which they are attached, combine to form a ring moiety (such as a succinimide), the hydrocarbyl substituent of one or both of $R_{10}$ and $R_{11}$ having a number average molecular weight of about 700 or greater (as described herein); $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and $M^{\ominus}$ is a carboxylate.

In one approach, the polyamine or, preferably, the ether amine used to form the quaternary ammonium salt additive of Formula II herein may have the structure of Formula III $$H_2N—(CH_2)_n—X_m—(CH_2)_n—X_m—(CH_2)_n—N(R_7)(R_8) \quad \text{(Formula III)}$$

with X, $R_7$, $R_8$ and integers n and m are defined above. In a preferred approach, the X moiety is an oxygen atom or nitrogen atom, and more preferably, an oxygen atom. In a preferred approach, the amine is 3-(2-(dimethyl amino) ethoxy)propylamine; N,N-dimethyldipropylenetriamine; or mixtures thereof.

Any of the foregoing described tertiary amines may be reacted with a hydrocarbyl substituted acylating agent having the noted high molecular weight hydrocarbyl substituent described herein to form the quaternary ammonium salt additive. In approaches, the hydrocarbyl substituted acylating agent may be selected from a hydrocarbyl substituted mono- di- or polycarboxylic acid or a reactive equivalent thereof to form an amide or imide compound. A particularly suitable acylating agent is a hydrocarbyl substituted succinic acid, ester, anhydride, mono-acid/mono-ester, or diacid. In some approaches, the hydrocarbyl substituted acylating agent is a hydrocarbyl substituted dicarboxylic acid or anhydride derivative thereof, a fatty acid, or mixtures thereof. The hydrocarbyl substituent may have a number average molecular weight of 700 or more as discussed above and, preferably about 700 to about 5,000 (or about 900 to about 2,500).

In other approaches, the hydrocarbyl substituted acylating agent may be carboxylic acid or anhydride reactant. In one approach, the hydrocarbyl substituted acylating agent may be selected from stearic acid, oleic acid, linoleic acid, linolenic acid, palmitic acid, palmitoleic acid, lauric acid, myristic acid, myristoleic acid, capric acid, caprylic acid, arachidic acid, behenic acid, erucic acid, anhydride derivatives thereof, or a combination thereof.

In one approach, the hydrocarbyl substituted acylating agent suitable for the quaternary ammonium salt additive is a hydrocarbyl substituted dicarboxylic anhydride of Formula IV (Formula IV)

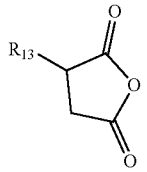

wherein $R_{13}$ of Formula IV is a hydrocarbyl or alkenyl group having a high molecular weight as discussed above. In some aspects, $R_{13}$ is a hydrocarbyl group having a number average molecular weight from about 700 to about 5,000, about 700 to about 2,500, or about 700 to about 1,500. In other approaches, the number average molecular weight of $R_{13}$ may range from about 700 to about 1300, as measured by GPC using polystyrene as a calibration reference. A particularly useful $R_{13}$ has a number average molecular weight of about 1000 Daltons and comprises polyisobutylene.

In some approaches, the $R_{13}$ of Formula IV is a hydrocarbyl moiety that may comprise one or more polymer units chosen from linear or branched alkenyl units. In some aspects, the alkenyl units may have from about 2 to about 10 carbon atoms. For example, the polyalkenyl radical may comprise one or more linear or branched polymer units formed from ethylene radicals, propylene radicals, butylene radicals, pentene radicals, hexene radicals, octene radicals and decene radicals. In some aspects, the $R_{13}$ polyalkenyl radical may be in the form of, for example, a homopolymer, copolymer or terpolymer. In other aspects, the polyalkenyl radical is polyisobutylene. For example, the polyalkenyl radical may be a homopolymer of polyisobutylene comprising from about 5 to about 60 isobutylene groups, such as from about 15 to about 30 isobutylene groups. The polyalkenyl compounds used to form the $R_{13}$ polyalkenyl radicals may be formed by any suitable methods, such as by conventional catalytic oligomerization of alkenes.

In some aspects, high reactivity polyisobutylenes having relatively high proportions of polymer molecules with a terminal vinylidene group may be used to form the $R_{13}$ group. In one example, at least about 60%, such as about 70% to about 90%, of the polyisobutenes comprise terminal olefinic double bonds. In some aspects, approximately one mole of maleic anhydride may be reacted per mole of polyalkylene, such that the resulting polyalkenyl succinic anhydride has about 0.8 to about 1.5 succinic anhydride group per polyalkylene substituent. In other aspects, the molar ratio of succinic anhydride groups to polyalkylene groups may range from about 0.5 to about 3.5, such as from about 1 to about 1.3.

A suitable alkylating or quaternizing agent for the quaternary ammonium salt additive is a hydrocarbyl-substituted carboxylate, such as an alkyl carboxylate or dialkyl carboxylate. In some approaches or embodiments, the quaternizing agent is an alkyl carboxylate selected form alkyl oxalate, dialkyl oxylate, alkyl salicylate, and combinations thereof. In other approaches or embodiments, the alkyl group of the alkyl carboxylate includes 1 to 6 carbon atoms, and is preferably methyl groups. Suitable alkylating or quaternizing agents for the second quaternary ammonium salt additive herein may be dimethyl oxylate or methyl salicylate.

For alkylation with an alkyl carboxylate, it may be desirable in some approaches that the corresponding acid of the carboxylate have a pKa of less than 4.2. For example, the corresponding acid of the carboxylate may have a pKa of less than 3.8, such as less than 3.5, with a pKa of less than 3.1 being particularly desirable. Examples of suitable carboxylates may include, but not limited to, maleate, citrate, fumarate, phthalate, 1,2,4-benzenetricarboxylate, 1,2,4,5-benzenetetracarboxylate, nitrobenzoate, nicotinate, oxalate, aminoacetate, and salicylate. As noted above, preferred carboxylates include oxalate, salicylate, and combinations thereof.

Suitable examples of the quaternary ammonium salt from the above described reactions for the quaternary ammonium salt additive include, but are not limited to, compounds of the following exemplary structures:

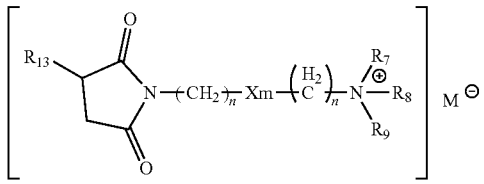

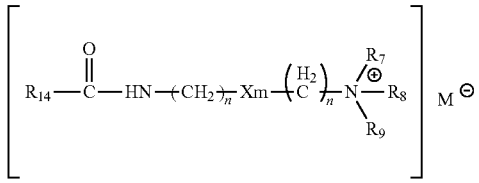

wherein X, $R_7$, $R_8$, $R_9$, $R_{13}$ and M as well as integers n and m are as described above. $R_{14}$ is a C1 to C30 hydrocarbyl group. Due to the length of the hydrocarbyl chain and the presence of the bivalent moiety therein having, in some approaches, an internal oxygen or nitrogen atoms (i.e., the X moiety) discussed above, it is believed the quaternary ammonium salts as described herein include a relatively sterically available quaternary nitrogen that is more available for detergent activity than prior quaternary ammonium compounds.

A fuel additive or additive package may include about 1 to about 30 weight percent of the above-described quaternary ammonium salt, about 2 to about 25 weight percent of the quaternary ammonium salt, or about 2 to about 10 weight percent of the quaternary ammonium salt (based on the total weight of the active detergent in the fuel additive). In other approaches, the fuel composition includes about 1 to about 50 ppmw, in other approaches, about 2 to about 25 ppmw, and in yet other approaches, about 4 to about 15 ppmw of the quaternary ammonium salt additive. Other ranges within the noted endpoints are also within the scope of this disclosure.

Alkoxylated Alcohol

The fuel additives or fuels of the present disclosure may also include one or more optional alkoxylated alcohols. The alkoxylated alcohol is preferably a polyether prepared by reacting an long chain alkyl alcohol or alkylphenol with an alkylene oxide. By one approach, the alkoxylated alcohol may be one or more hydrocarbyl-terminated or hydrocarbyl-capped poly(oxyalkylene) polymers. The hydrocarbyl moieties thereof may be aryl or aliphatic groups, and preferably, aliphatic chains that are linear, branched or cyclic, and most preferably are linear aliphatic chains. In one approach, the alkoxylated alcohols may have the structure of Formula Va, Vb, and/or Vc below:

(Formula Va)

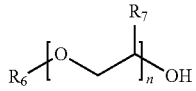

-continued (Formula Vb)

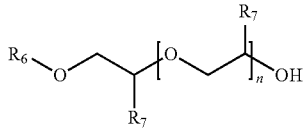

(Formula Vc)

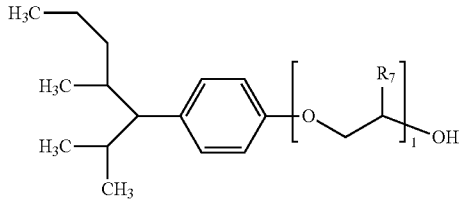

wherein $R_6$ of the Formulas Va, Vb, and/or Vc is an aryl group or a linear, branched, or cyclic aliphatic group and preferably having 5 to 50 carbons (or 5 to 30 carbons) or may be a $—C_mH_{2m+1}$ group where m is an integer of 12 or more, $R_7$ of Formulas Va, Vb, and/or Vc is a C1 to C4 alkyl group, and n is an integer from 5 to 100 (or as further discussed below).

In some approaches, suitable alkoxylated alcohols are derived from lower alkylene oxides selected from the group consisting of ethylene oxide, propylene oxide, butylene oxide, copolymers thereof, and combinations thereof. Preferably, the lower alkylene oxides are propylene oxide or butylene oxide or copolymers of ethylene oxide, propylene oxide, and butylene oxide (as well as any combinations thereof). In another approach, the alkylene oxides are propylene oxide. Any copolymers of such alkylene oxides may be random or block copolymers. In one approach, the alkoxylated alcohols may be terminated or capped with an aryl, alkyl, or hydrocarbyl group and may include one or more aryl or linear, branched, or cyclic aliphatic C5 to C30 terminated alkoxylated alcohols, and in other approaches, a C16 to C18 (or blend thereof) terminated alkoxylated alcohol having 5 to 100, 10 to 80, 20 to 50, or 22 to 32 repeating units of the alkylene oxide therein (that is, n integer of the formula above). In some approaches, the alkoxylated alcohols may have a weight average molecular weight of about 1300 to about 2600 and, in other approaches, about 1600 to about 2200.

In some approaches, the aliphatic hydrocarbyl terminated alkoxylated alcohols may include about 20 to about 70 weight percent (in another approach, about 30 to about 50 weight percent) of an aliphatic C16 alkoxylated alcohol having 24 to 32 repeating units of alkoxylene oxide and/or may include about 80 to about 30 weight percent (in another approach, about 50 to about 70 weight percent) of an aliphatic C18 alkoxylated alcohol having 24 to 32 repeating units of alkoxylene oxide. In other approaches, the fuel additives herein, if including an alkoxylated alcohol, may also have about 8 percent or less (in other approaches, about 6 percent or less, and in yet other approaches, about 4 percent or less) of C20 or greater alkoxylated alcohols and/or about 4 weight percent or less (in or other approaches about 2 weight percent or less, and in yet other approaches, about 1 percent or less) of C14 or lower alkoxylated alcohols.

The aryl or hydrocarbyl-capped poly(oxyalkylene) alcohols may be produced by the addition of lower alkylene oxides, such as ethylene oxide, propylene oxide, or the butylene oxides, to a desired hydroxy compound R—OH (that is, a starter alcohol) under polymerization conditions, wherein R is the aryl or hydrocarbyl group having either 5 to 30 carbons or other chain length as noted above and which caps the poly(oxyalkylene) chain. The alkoxylated alcohols can be prepared by any starter alcohol that provides the desired polyol distribution. By one approach, the alkoxylated alcohol can be prepared by reacting a saturated linear or branched alcohol of the desired hydrocarbon size with the selected alkylene oxide and a double metal or basic catalyst. In one approach, the alkoxylated alcohol may be nonylphenol alkoxylated alcohol such as nonylphenol propoxylated alcohol.

In other approaches, in the polymerization reaction a single type of alkylene oxide may be employed, e.g., propylene oxide, in which case the product is a homopolymer, e.g., a poly(oxyalkylene) propanol. However, copolymers are equally satisfactory and random or block copolymers are readily prepared by contacting the hydroxyl-containing compound with a mixture of alkylene oxides, such as a mixture of ethylene, propylene, and/or butylene oxides. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. In one example, a particular block copolymer may be represented by a polymer prepared by polymerizing propylene oxide on a suitable mono-hydroxy compound to form a poly(oxypropylene) alcohol and then polymerizing butylene oxide on the poly (oxyalkylene) alcohol.

A fuel additive or fuel herein, when included, may include about 5 to about 30 weight percent of the alkoxylated alcohol, about 8 to about 20 weight percent of the alkoxylated alcohol, or about 10 to about 15 weight percent of the alkoxylated alcohol (based on the active alkoxylated alcohol in the fuel additive). When blended into a gasoline fuel, the fuel may optionally include about 2 ppmw to about 150 ppmw of the active alkoxylated alcohol, 5 to about 150 ppmw, about 8 ppmw to about 50 ppmw, or about 15 ppmw to about 40 ppmw of the alkoxylated alcohol in the fuel.

Succinimide Detergents

The fuel additives or fuels herein may also include one or more optional hydrocarbyl substituted dicarboxylic anhydride derivatives, and preferably one or more optional succinimide detergents. In one approach, this optional additive may be prepared by reacting a hydrocarbyl-substituted succinic acylating agent with an amine, polyamine, or alkyl amine having one or more primary, secondary, or tertiary amino groups. In some embodiments, the hydrocarbyl substituted dicarboxylic anhydride derivative includes hydrocarbyl succinimides, succinamides, succinimide-amides and succinimide-esters. These nitrogen-containing derivatives of hydrocarbyl succinic acylating agents may be prepared by reacting a hydrocarbyl-substituted succinic acylating agent with an amine, polyamine, or alkyl amine having one or more primary, secondary, or tertiary amino groups. The detergents may be mono-succinimides, bis-succinimides, or combinations thereof.

In some approaches or embodiments, the hydrocarbyl substituted dicarboxylic anhydride derivative may include a hydrocarbyl substituent having a number average molecular weight ranging from about 450 to about 3,000 as measured by GPC using polystyrene as reference. The derivative may be selected from a diamide, acid/amide, acid/ester, diacid, amide/ester, diester, and imide. Such derivative may be made from reacting a hydrocarbyl substituted dicarboxylic anhydride with ammonia, a polyamine, or an alkyl amine having one or more primary, secondary, or tertiary amino groups. In some embodiments, the polyamine or alkyl amine may be tetraethylene pentamine (TEPA), triethylenetetramine (TETA), and the like amines. In other approaches, the polyamine or alkyl amine may have the formula $H_2N((CHR_1—(CH_2)_q NH)_r—H$, wherein $R_1$ of the previous formula is hydrogen or an alkyl group having from 1 to 4 carbon atoms, q is an integer of from 1 to 4 and r is an integer of from 1 to 6, and mixtures thereof. In other approaches, a molar ratio of the hydrocarbyl substituted dicarboxylic anhydride reacted with the ammonia, polyamine, or alkyl amine may be from about 0.5:1 to about 2:1, in other approaches about 1:1 to about 2:1.

In other approaches, the hydrocarbyl substituted dicarboxylic anhydride may be a hydrocarbyl carbonyl compound of the Formula VI:

(Formula VI)

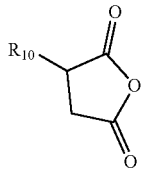

where $R_{10}$ of Formula VI is a hydrocarbyl group derived from a polyolefin. In some aspects, the hydrocarbyl carbonyl compound may be a polyalkylene succinic anhydride reactant wherein $R_{10}$ is a hydrocarbyl moiety, such as for example, a polyalkenyl radical having a number average molecular weight of from about 450 to about 3000 as measured by GPC using polystyrene as reference. For example, the number average molecular weight of $R_{10}$ may range from about 600 to about 2,500, or from about 700 to about 1,500, as measured by GPC using polystyrene as reference. A particularly useful $R_{10}$ of Formula VI may have a number average molecular weight of about 950 to about 1,000 Daltons (as measured by GPC using polystyrene as reference) and comprises polyisobutylene. Unless indicated otherwise, molecular weights in the present specification are number average molecular weights as measured by GPC using polystyrene as reference.

In approaches, the $R_{10}$ of Formula VI is a hydrocarbyl moiety that may include one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the $R_{10}$ polyalkenyl radical of Formula VI may be in the form of, for example, a homopolymer, copolymer or terpolymer. In one aspect, the polyalkenyl radical is isobutylene. For example, the polyalkenyl radical may be a homopolymer of polyisobutylene comprising from about 10 to about 60 isobutylene groups, such as from about 20 to about 30 isobutylene groups. The polyalkenyl compounds used to form the $R_{10}$ polyalkenyl radicals may be formed by any suitable methods, such as by conventional catalytic oligomerization of alkenes.

In some aspects, high reactivity polyisobutenes having relatively high proportions of polymer molecules with a terminal vinylidene group may be used to form the $R_{10}$ group. In one example, at least about 60%, such as about 70% to about 90%, of the polyisobutenes comprise terminal olefinic double bonds. High reactivity polyisobutenes are disclosed, for example, in U.S. Pat. No. 4,152,499, the disclosure of which is herein incorporated by reference in its entirety.

In some aspects, approximately one mole of maleic anhydride may be reacted per mole of polyalkylene, such that the resulting polyalkenyl succinic anhydride has about 0.8 to about 1 succinic anhydride group per polyalkylene substituent. In other aspects, the molar ratio of succinic anhydride groups to polyalkylene groups may range from about 0.5 to about 3.5, such as from about 1 to about 1.1.

The hydrocarbyl carbonyl compounds may be made using any suitable method. One example of a method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide. Another exemplary method of making the polyalkylene succinic anhydrides is described in U.S. Pat. No. 4,234,435, which is incorporated herein by reference in its entirety.

In the hydrocarbyl substituted dicarboxylic anhydride derivative, the polyamine reactant may be an alkylene polyamine. For example, the polyamine may be selected from ethylene polyamine, propylene polyamine, butylenes polyamines, and the like. In one approach, the polyamine is an ethylene polyamine that may be selected from ethylene diamine, diethylene triamine, triethylene tetramine, tetraethylene pentamine, pentaethylene hexamine, and N, N'-(iminodi-2,1,ethanediyl) bis-1,3-propanediamine. A particularly useful ethylene polyamine is a compound of the formula $H_2N—((CHR_1—(CH_2)_q—NH)_r—H$, wherein $R_1$ is hydrogen, q is 1 and r is 4.

In yet further approaches, the hydrocarbyl substituted dicarboxylic anhydride derivative is a compound of Formula VII (Formula VII)

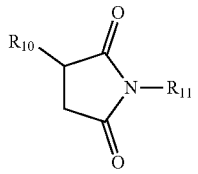

wherein $R_{10}$ of Formula VII is a hydrocarbyl group (such as polyisobutylene and/or the other above described $R_{10}$ moieties) and $R_{11}$ of Formula VII is a hydrogen, an alkyl group, an aryl group, —OH, —$NHR_{12}$, or a polyamine, or an alkyl group containing one or more primary, secondary, or tertiary amino groups. In some approaches, $R_{11}$ of Formula VII is derived from ethylene diamine, diethyelene triamine, triethylene tetraamine, tetraethylene pentamine, pentaethylene hexamine, N,N'-(iminodi-2,1,ethanediyl)bis-1,3-propanediamine and combinations thereof. In some embodiments of Formula VII, $R_{10}$ is a hydrocarbyl group and $R_{11}$ is hydrogen, an alkyl group, an aryl group, —OH, —$NHR_{12}$, or a polyamine and wherein $R_{12}$ of this formula is a hydrogen or an alkyl group. In other embodiments, the additive of Formula VII includes a hydrocarbyl substituted succinimide derived from ethylene diamine, diethylene triamine, triethylene tetraamine, tetraethylene pentamine, pentaethylene hexamine, N,N'-(iminodi-2,1,ethanediyl)bis-1,3-propanediamine and combinations thereof. In still other embodiments, $R_{10}$ in the compound of Formula VII is a hydrocarbyl group having a number average molecular weight from about 450 to about 3,000 and $R_{11}$ of Formula VII is derived from tetraethylene pentamine and derivatives thereof.

In yet other approaches $R_{11}$ of Formula VII is a compound of Formula VIII (Formula VIII)

$$—((CH_2)_m A)_n(CH_2)_p NR_{13}R_{14}$$

wherein A is $NR_{12}$ or an oxygen atom, $R_{12}$, $R_{13}$, and $R_{14}$ of Formula VIII are independently a hydrogen atom or an alkyl group, m and p are integers from 2 to 8; and n is an integer from 0 to 4. In some approaches, $R_{13}$ and $R_{14}$ of Formula VIII, together with the nitrogen atom to which they are attached, form a 5 membered ring. In approaches, the succinimide detergent is a hydrocarbyl substituted monosuccinimide detergent, a hydrocarbyl substituted bis-succinimide detergent, or a combination thereof.

A fuel additive or fuel herein, when included, may include about 0.1 to about 10 weight percent of the active succinimide detergent, about 0.5 to about 8 weight percent of the succinimide detergent, or about 1 to about 5 weight percent of the succinimide detergent (based on the total weight of the active succinimide within the fuel additive). When blended into a gasoline fuel, the fuel may optionally include about 0.5 ppmw to about 20 ppmw of the active succinimide detergent, about 1 ppmw to about 10 ppmw, or about 2 ppmw to about 5 ppmw of the succinimide detergent in the fuel.

Fuel Additive:

When formulating the fuel compositions of this application, the above described additives (including at least the Mannich detergent and the quaternary ammonium salt) may be employed in amounts sufficient to reduce or inhibit deposit formation in a fuel system, a combustion chamber of an engine and/or crankcase, and/or within fuel injectors and within a gasoline direction injection engine and/or a port fuel injection engine. Such additives may also be provided in amounts to improve injector performance as described herein. In some aspects, the fuel additive or fuel additive package herein may include at least the above described Mannich detergent, the quaternary ammonium salt, an optional alkoxylated alcohol, and an optional succinimide detergent. The fuel additives herein may also include other optional additives as needed for a particular application and may include as needed one or more of a demulsifier, a corrosion inhibitor, an antiwear additive, an antioxidant, a metal deactivator, an antistatic additive, a dehazer, an anti-knock additive, a lubricity additive, and/or a combustion improver.

In some approaches or embodiments, the fuel additive or additive package herein may include about 20 to about 60 weight percent of the Mannich detergent and about 1 to about 20 weight percent of the quaternary ammonium salt (or any other ranges therebetween). In other approaches, the fuel additive or additive package may also include about 5 to about 20 weight percent of the alkoxylated alcohol and/or about 0.1 to about 10 weight percent of the Succinimide detergent (or any other ranges therebetween)

In other approaches, a gasoline fuel composition may include about 40 to about 750 ppmw of the fuel additive or additive package herein, in other approaches, about 60 to about 380 ppmw, or about 135 to about 310 ppmw of the above noted fuel additive package and which provides about 15 to about 300 ppmw of the Mannich detergent and about 0.1 to about 50 ppmw of the quaternary ammonium salt to the fuel. In other embodiments, the fuel may also include about 2 to about 90 ppmw of the alkoxylated alcohol and/or about 0.5 to about 20 ppmw of the succinimide detergent. It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In other approaches, the fuel additive package or fuel thereof also has a certain weight ratio of the alkoxylated alcohol to the Mannich detergent of 1.0 or less (i.e., 1.0:1 or less), about 0.8 or less, about 0.6 or less, about 0.5 or less, about 0.4 or less, or about 0.3 or less, and about 0.1 or more (i.e., 0.1:1), about 0.2 or more, or about 0.3 or more. In yet other approaches, the fuel additive package or fuel thereof may also have a weight ratio of the Mannich detergent to the quaternary ammonium salt of about 4:1 to about 100:1 or about 4:1 to about 50:1 or about 6:1 to about 10:1 (wherein the weight ratios are active Mannich detergent to the active quaternary ammonium salt additive).

Other Additives

One or more optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above optional additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

Other commercially available detergents may be used in combination with the reaction products described herein. Such detergents include but are not limited to succinimides, Mannich base detergents, PIB amine, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines, and preferably, spark-ignition or gasoline engines. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. Preferably, the additives herein are used in spark-ignition fuels or gasoline. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to methods of or the use of the noted fuel additive package for controlling or reducing fuel injector deposits, controlling or reducing intake valve deposits, controlling or reducing combustion chamber deposits, and/or controlling or reducing intake valve sticking in one of port-injection engines, direct-injection engines, and preferably both engine types. In some aspects, the method may also comprise mixing into the fuel at least one of the optional additional ingredients described above. The improved engine performance may be evaluated pursuant to the test protocols of ASTM D6201 or by the methods as set forth in the following two SAE publications: Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated herein by reference. Intake valve sticking may be evaluated using the test protocols at Southwest Research Institute (SWRI, San Antonio Texas) or similar test house.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mp of about 162 to about 14,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 0.38 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein. The specifications for base fuels A, B, and C used in the Examples are shown below in Table 1.

TABLE 1

Fuel Specifications.

| FUEL PROPERTY | BASE FUEL A | BASE FUEL B | BASE FUEL C |
|---|---|---|---|
| API Gravity | 60.3 | 58.5 | 58.7 |
| Specific Gravity | 0.7377 | 0.7447 | 0.7440 |
| Density | 0.7370 | 0.7440 | 0.7432 |
| % Benzene | 0.47 | <0.10 | n.a. |
| Bromine No. | 9.7 | <0.5 | n.a. |
| BTU Gross (btu/lb) | 18711 | 19614 | 19674 |
| BTU Net (btu/lb) | 17477 | 18409 | 18465 |
| Unwashed Gum (ASTM D-381) | 3 | 3.5 | 1.5 |
| Washed Gum (ASTM D-381) | <0.5 | <0.5 | <0.5 |
| ASTM D-525 Oxidation (minutes) | 960 | 960+ | 960+ |
| RVP (ASTM D-5191) | 9.46 | 8.76 | 8.8 |
| % Carbon | 82.63 | 86.79 | n.a. |
| % Hydrogen | 13.53 | 13.21 | n.a. |
| Aromatics (vol-%) | 27.9 | 29.1 | 30.7 |
| Olefins (vol-%) | 4.7 | 1.2 | 9.2 |
| Saturates (vol-%) | 67.4 | 69.7 | 60.1 |

TABLE 1-continued

| Fuel Specifications. | | | |
|---|---|---|---|
| FUEL PROPERTY | BASE FUEL A | BASE FUEL B | BASE FUEL C |
| Ethanol (vol-%) | 9.3 | <0.10 | n.a. |
| Oxygen Content | 3.84 | <0.02 | 0 |
| Sulfur (ppm) | 8.4 | 30 | 4.6 |
| RON | 98.2 | 97.4 | 91.4 |
| MON | 87.5 | 89 | 83.3 |
| Octane (R + M)/2 | 92.85 | 93.2 | 87.35 |
| ASTM D-86 (Temperature ° F.) | | | |
| Initial Boiling Point | 87 | 84.6 | 91.3 |
| 5% | 99.9 | 108 | 113.7 |
| 10% | 110.5 | 121.5 | 125 |
| 20% | 125.2 | 104.6 | 140.2 |
| 30% | 140.3 | 163 | 157.1 |
| 40% | 152.5 | 191.4 | 174.2 |
| 50% | 165.6 | 215.8 | 193.3 |
| 60% | 228.4 | 228.4 | 227.1 |
| 70% | 250.5 | 237.3 | 257.8 |
| 80% | 276 | 254 | 288.5 |
| 90% | 316 | 337.5 | 332.6 |
| 95% | 343.6 | 338.4 | 368.4 |
| End Point | 398.5 | 398.7 | 423.8 |
| % Recovery | 96.1 | 97.3 | 97.2 |
| Residue | 1.1 | 1.1 | 1.1 |
| Loss | 2.8 | 1.6 | 1.7 |

Example 1

In a 4 liter glass reaction vessel 1999.98 grams (2.10 moles) of Dovermulse H 1000 polyisobutylene succinic anhydride (PIBSA made using 1000 MW polyisobutylene available from Dover Chemical) and 1 drop of silicone fluid (as an antifoam agent) were mixed and heated to 167° C. under a blanket of nitrogen. Once the mixture had reached 167° C., 307.21 grams (2.10 moles) of 3-(2-(dimethylamino) ethoxy) propylamine (DMAEPA) was added over the course of 11 minutes. Once the DMAEPA was added, a vacuum (26" Hg) was applied to the mixture to remove the water generated during the formation of the imide. The mixture was stirred and held under vacuum at 167° C. for 2 hours. An IR spectrum of the product confirmed the formation of the polyisobutylene succinimide (PIBSI), a brown viscous liquid.

In a 4 liter glass reaction vessel 1600.02 grams (1.48 moles) of the PIBSI and 198.00 grams of Solvesso 150 ND aromatic solvent (available from ExxonMobil Chemical) were mixed and heated to 125° C. under a blanket of nitrogen. Next, 183.62 grams (1.55 moles) of dimethyl oxalate was added and the mixture was maintained at 125° C. for 3 hours with constant stirring. A $^{13}C$ NMR spectrum of the brown viscous liquid product confirmed the formation of the quaternary ammonium salt. For ease of handling, an additional 566.45 grams of Solvesso 150 ND was added to bring the mixture to 70/30 weight % product/solvent.

Example 2

Inventive and Comparative fuel additive packages at the treat rates of Table 2 below were prepared in Base Fuel A. The Mannich detergent was prepared from a high reactivity polyisobutylene cresol, dibutylamine, and formaldehyde according to a known method (see, e.g., U.S. Pat. No. 6,800,103, which is incorporated herein by reference); the quaternary ammonium salt was from Example 1; the propoxylated alcohol was a blend of commercially available C16-C18 propoxylated alcohols; and the succinimide detergent was a 950 number average molecular weight polyisobutenyl mono-succinimide derived from tetraethylene pentaamine (TEPA).

TABLE 2

| Treat Rates in Base Fuel A | | | | |
|---|---|---|---|---|
| Ingredients | Comparison 1 ppmw | Comparison 2 ppmw | Comparison 3 ppmw | Inventive 1 ppmw |
| Mannich Detergent | 0 | 69 | 80 | 68 |
| Quaternary Ammonium Salt | 8 | 0 | 0 | 8 |
| Propoxylated alcohol | 34 | 34 | 40 | 34 |
| Succinimide Detergent | 0 | 0 | 17 | 0 |
| Propoxylated alcohol to Mannich detergent weight ratio | — | 0.49:1 | 0.5:1 | 0.5:1 |
| Mannich detergent to Quaternary ammonium salt weight ratio | — | — | — | 8.5:1 |

The additive packages of Table 2 were blended into Base Fuel A at the treat rates set forth in Table 2. Each additive package of Table 2 also contained other non-detergent ingredients, such as demulsifier, corrosion inhibitor, and solvent. The fuel was then evaluated for intake valve deposits and improvements from the base fuel without the additive determined pursuant to ASTM D6201.

TABLE 3

| IVD (ASTM D6201) | | | | | |
|---|---|---|---|---|---|
| | Base Fuel | Comparison 1 | Comparison 2 | Comparison 3 | Inventive 1 |
| IVD, mg | 785.3 | 727 | 60.3 | 78.8 | 48.0 |
| Improvement from Base Fuel IVD, % | | 7.4% | 92.3% | 90.0% | 94.0% |

As shown in Table 3 above, the inventive samples exhibited the best IVD results as compared to the base fuel.

Example 3

A series of tests were run to evaluate the impact that the additive packages of Example 1 at the treat rates of Table 2 have on fuel inject deposits in a gasoline direct injection engine (GDI). All tests were run with a consistent Base Fuel C during a Dirty-up (DU), Clean-up (CU) and/or Keep Clean (KC) phases of the respective test.

Each base fuel was investigated for a DU level by indirect measurements of injector fouling, such as by pulse width or long term fuel trim (LTFT), on a 2008 Pontiac Solctice vehicle pursuant to the RIFT methods as set forth in Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated by reference herein.

In order to accelerate the DU phase of the Base Fuel, a combination of di-tert-butyl disulfide (DTBDS 406 ppmw)

and tert-butyl hydrogen peroxide (TBHP, 286 ppmw) were added to the base fuel and the DU was accelerated to provide the fouling in the range of 5-12%.

The DU procedure was run between 2000-3000 miles to achieve delta LTFT (Δ=end of DU−beginning of DU) of about 6.0% or above. At the end of DU, the fuel was changed to an additized formulation that is designed to have a clean-up effect. Percentage of CU (%) is calculated as:

$$CU\% = \frac{-(LTFT \text{ at end of } CU - LTFT \text{ at end of } DU) \times 100\%}{(LTFT \text{ at end of } DU - LTFT \text{ in the begining of } DU)}$$

With combination of Mannich and Quaternary ammonium salt additive of Example 1 in Inventive Sample 1, the clean-up was 58.5%, while clean-up with the Mannich alone in Comparative Sample 2 was only 9.3% and clean-up with the quaternary ammonium salt alone was 45.3% as generally shown in FIG. 1. Thus, the clean-up of the combination was synergistically better than either additive individually.

TABLE 4

| Clean-Up performance | | | | |
|---|---|---|---|---|
| | Comparative 1 | Comparative 2 | Comparative 3 | Inventive 1 |
| GDI CU by RIFT method, % | 45.3 | 9.3 | — | 58.5 |

As shown in Table 4 above, the Inventive examples exhibited improved injector clean-up relative to the comparative examples. FIG. 1 also shows the LTFT of Comparative 1, Comparative 2, and Inventive 1 during the dirty up and the clean-up phases of the testing. The Inventive 1 fuel additive, as shown in FIG. 1 and Tables 3 and 4, including the Mannich detergent and quaternary ammonium salt exhibited a synergistic effect not expected from each of the additives individually.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A fuel additive package for a spark-ignition engine comprising:

a Mannich detergent including the reaction product of a hydrocarbyl-substituted phenol, one or more aldehydes, and one or more amines, wherein the Mannich detergent has the structure of Formula I:

(Formula I)

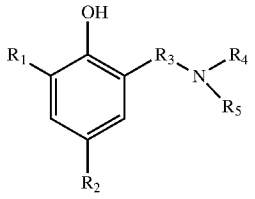

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group;

a quaternary ammonium salt additive having the structure of Formula II $$[(R_{10})(R_{11})N—(CH_2)_n—X_m—(CH_2)_n—X_m—(CH_2)_n—N^{\oplus}(R_7)(R_8)(R_9)]M^{\ominus} \quad \text{(Formula II)}$$

wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and $R_{11}$ are independently selected from hydrogen, an alkyl group, an acyl group, or a hydrocarbyl substituted acyl group, the hydrocarbyl substituent of one or both of $R_{10}$ and $R_{11}$ having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and $M^{\ominus}$ is a carboxylate;

an alkoxylated alcohol, wherein a weight ratio of the alkoxylated alcohol to the Mannich detergent is about 0.8 or less, wherein the alkoxylated alcohol is a polyether having the structure of Formula Va:

(Formula Va)

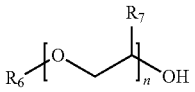

wherein $R_6$ is an aryl group or a linear, branched, or cyclic aliphatic group having 5 to 50 carbons, $R_7$ is a C1 to C4 alkyl group, and n is an integer from 5 to 100;

wherein a weight ratio of the Mannich detergent to the quaternary ammonium salt additive is about 4:1 to about 10:1; and wherein the fuel additive package includes about 20 to about 70 weight percent of the Mannich detergent, about 1 to about 20 weight percent of the quaternary ammonium salt additive, and about 5 to about 30 weight percent of the alkoxylated alcohol.

2. The fuel additive package of claim 1, wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof.

3. The fuel additive package of claim 1, wherein $R_{10}$ and $R_{11}$ of the quaternary ammonium salt of Formula II, together with the nitrogen atom to which they are attached, combine to form a ring moiety.

4. The fuel additive package of claim 1, wherein the carboxylate of the quaternary ammonium salt of Formula II is oxalate, salicylate, or combinations thereof.

5. The fuel additive package of claim 4, wherein X of Formula II is —O— or —NH—.

6. The fuel additive package claim 5, wherein the quaternary ammonium salt is derived from 3-(2-(dimethylamino)ethoxy)propylamine, N,N-dimethyldipropylenetriamine, or mixtures thereof.

7. The fuel additive package of claim 1, wherein $R_{10}$ and $R_{11}$ of the quaternary ammonium salt of Formula II, together with the nitrogen atom to which they are attached, combine to form a hydrocarbyl substituted succinimide.

8. The fuel additive package of claim 7, wherein the hydrocarbyl substituent has a number average molecular weight of about 700 to about 2,500.

9. The fuel additive package of claim 1, wherein X moiety of the quaternary ammonium salt of Formula II is an oxygen atom and wherein $R_{10}$ and $R_{11}$ of the quaternary ammonium salt, together with the nitrogen atom to which they are attached, combine to form a hydrocarbyl substituted succinimide with the hydrocarbyl substituent having a number average molecular weight of about 700 to about 1,500 as measured by GPC using polystyrene as a calibration reference.

10. The fuel additive package of claim 1, wherein the fuel additive package includes about 20 to about 60 weight percent of the Mannich detergent.

11. The fuel additive package of claim 1, further comprising a succinimide detergent prepared by reacting a hydrocarbyl-substituted succinic acylating agent with an amine, polyamine, or alkyl amine having one or more primary, secondary, or tertiary amino groups.

12. The fuel additive package of claim 11, wherein the fuel additive package includes about 0.1 to about 10 weight percent of the succinimide detergent.

13. The fuel additive package of claim 12, wherein the succinimide detergent is a hydrocarbyl substituted monosuccinimide detergent, a hydrocarbyl substituted bis-succinimide detergent, or a combination thereof.

14. The fuel additive package of claim 12, further comprising one or more of a demulsifier, a corrosion inhibitor, an antiwear additive, an antioxidant, a metal deactivator, an antistatic additive, a dehazer, an antiknock additive, a lubricity additive, and/or a combustion improver.

15. A gasoline fuel composition comprising about 55 to about 125 ppmw of a Mannich detergent including the reaction product of a hydrocarbyl-substituted phenol, one or more aldehydes, and one or more amines, wherein the Mannich detergent has the structure of Formula I:

(Formula I)

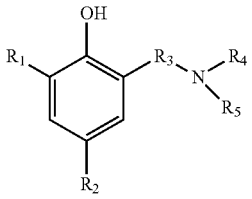

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a C1 to C4 alkyl amino C1-C12 alkyl group;

about 4 to about 15 ppmw of a quaternary ammonium salt additive has the structure of Formula II $$[(R_{10})(R_{11})N—(CH_2)_n—X_m—(CH_2)_n—X_m—(CH_2)_n—N^{\oplus}(R_7)(R_8)(R_9)]M^{\ominus} \quad \text{(Formula II)}$$

wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and $R_{11}$ are independently selected from hydrogen, an alkyl group, an acyl group, or a hydrocarbyl substituted acyl group, the hydrocarbyl substituent of one or both of $R_{10}$ and $R_{11}$ having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and $M^{\ominus}$ is a carboxylate; and about 15 to about 40 ppmw of an alkoxylated alcohol, wherein a weight ratio of the alkoxylated alcohol to the Mannich detergent is about 0.8 or less, wherein the alkoxylated alcohol is a polyether having the structure of Formula Va:

(Formula Va)

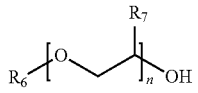

wherein $R_6$ is an aryl group or a linear, branched, or cyclic aliphatic group having 5 to 50 carbons, $R_7$ is a C1 to C4 alkyl group, and n is an integer from 5 to 100; and wherein a weight ratio of the Mannich detergent to the quaternary ammonium salt additive is about 4:1 to about 10:1.

16. A method of improving the injector performance of a gasoline direct injection (GDI) engine, the method comprising:

operating the gasoline direct injection engine on a fuel composition containing a major amount of a gasoline fuel and a minor amount of the fuel additive package of claim 1; and wherein the fuel additive package in the gasoline fuel improves the injector performance of the gasoline direct injection engine.

17. The method of claim 16, wherein the improved injector performance is one of improved fuel flow, improved fuel economy, improved engine efficiency, or combinations thereof.

18. The method of claim 17, wherein the improved injector performance is measured by one of injector pulse width, injection duration, injector flow, or combinations thereof.

* * * * *